US009296220B2

(12) United States Patent
Takabatake et al.

(10) Patent No.: US 9,296,220 B2
(45) Date of Patent: Mar. 29, 2016

(54) PRINTER APPARATUS

(71) Applicant: FUJITSU COMPONENT LIMITED, Tokyo (JP)

(72) Inventors: Yoshinari Takabatake, Tokyo (JP); Sumio Watanabe, Tokyo (JP); Yukihiro Mori, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 14/463,750

(22) Filed: Aug. 20, 2014

(65) Prior Publication Data

US 2015/0062280 A1 Mar. 5, 2015

(30) Foreign Application Priority Data

Aug. 28, 2013 (JP) ..... 2013-177130

(51) Int. Cl.

| | |
|---|---|
| ***B41J 2/335*** | (2006.01) |
| ***B41J 2/33*** | (2006.01) |
| ***B41J 11/04*** | (2006.01) |
| ***B41J 15/04*** | (2006.01) |

(52) U.S. Cl.

CPC .. *B41J 2/33* (2013.01); *B41J 2/335* (2013.01); *B41J 2/3358* (2013.01); *B41J 2/33505* (2013.01); *B41J 11/04* (2013.01); *B41J 15/042* (2013.01)

(58) Field of Classification Search

USPC ..... 347/205, 207

See application file for complete search history.

(56) References Cited

U.S. PATENT DOCUMENTS

| | | | | |
|---|---|---|---|---|
| 6,744,457 | B2 | 6/2004 | Seino et al. | |
| 7,492,384 | B2 * | 2/2009 | Takahashi | 347/220 |
| 7,542,061 | B2 * | 6/2009 | Han | 347/200 |
| 2006/0291933 | A1 | 12/2006 | Watanabe et al. | |
| 2008/0180468 | A1 | 7/2008 | Takahashi | |
| 2014/0232806 | A1 | 8/2014 | Tsuchiya et al. | |

FOREIGN PATENT DOCUMENTS

| | | |
|---|---|---|
| EP | 2193926 | 6/2010 |
| JP | H07-068866 | 3/1995 |
| JP | 2585769 | 2/1997 |
| JP | 2003-246104 | 9/2003 |
| JP | 2011-056956 | 3/2011 |
| WO | 2013/051631 | 4/2013 |

* cited by examiner

*Primary Examiner* — Huan Tran

(74) *Attorney, Agent, or Firm* — IPUSA, PLLC

(57) ABSTRACT

A printer apparatus includes a platen roller, a printer head for performing a printing on a recording paper provided between the printer head and the platen roller, a recording paper guide mounted to a part of a front surface of the printer head to guide the recording paper, and a spring positioned on a rear surface of the printer head to exert force toward the platen roller. The spring causes the printer head and the recording paper guide to move together toward a position in which the platen roller is mounted.

9 Claims, 8 Drawing Sheets

PRINTER APPARATUS

CROSS-REFERENCE TO RELATED APPLICATIONS

This application is based upon and claims the benefit of priority of the prior Japanese Patent Application No. 2013-177130 filed on Aug. 28, 2013, the entire contents of which are incorporated herein by reference.

FIELD

The embodiments discussed herein are related to a printer apparatus.

BACKGROUND

A printer apparatus for outputting a receipt or the like is widely used for various purposes such as a cashier terminal of a shop or an ATM (Automated Teller Machine) or a cash dispenser of a bank. For example, a printer apparatus outputs a receipt by printing characters or the like on a recording paper (e.g., heat sensitive paper) with a thermal head while conveying the recording paper until the recording paper reaches a predetermined length, and cutting the recording paper upon reaching the predetermined length.

The printer apparatus includes, for example, a printer body and a cover part rotatably supported by the printer body. By opening the cover part, a roll of recording paper can be placed into the printer body. In this case, for example, a thermal head may be placed in the printer body, and a platen roller may be placed in the cover part. By closing the cover part, the recording paper can be sandwiched between, for example, the thermal head and the platen roller. In this state where the recording paper is sandwiched between the thermal head and the platen roller, printing by the thermal head is performed.

[Patent Document 1]: Japanese Patent No. 2585769

[Patent Document 2]: Japanese Laid-Open Patent Publication No. 7-68866

[Patent Document 3]: Japanese Laid-Open Patent Publication No. 2003-246104

As illustrated in FIGS. 1A and 1B, a thermal head 910 mounted on a printer body includes a heat radiation plate 911 attached thereto. Further, the thermal head 910 includes a spring (not illustrated) provided on a side in which the heat radiation plate 911 is provided. In a state where a platen roller 920 is mounted on the printer body as illustrated in FIG. 1A, the thermal head 910 is pressed toward the platen roller 920 by a recovering force exerted from the spring. Thus, in a case where the platen roller 920 is removed as illustrated in FIG. 1B, the recovering force of the spring urges the thermal head 910 to move toward a side in which the platen roller 920 is provided.

As illustrated in FIGS. 1A and 1B, in the printer body, a recording paper guide 930 or a recording paper sensor 931 for detecting a recording paper are provided in the vicinity in which the platen roller 920 is provided. In a case where the thermal head 910 is moved by the recovering force of the spring, a space of a predetermined interval is provided between the thermal head 910 and the recording paper guide 930, so that the thermal head 910 is prevented from contacting the recording paper guide 930. However, the space between the thermal head 910 and the recording paper guide 930 prevents size-reduction of the printer apparatus. Further, in a case where the space of the predetermined interval is provided between the thermal head and the recording paper guide, the recording paper guide 930 that constitutes a paper conveying path is to be formed with a gradual inclination. This increases the size of the recording paper guide 930 and leads to size-increase of the printer apparatus.

The thermal head 910 has, for example, an IC (Integrated Circuit) 910*a* projecting toward a side in which the thermal head 910 contacts a recording paper. Thus, in a case where a recording paper contacts the IC 910*a*, the recording paper may be scratched and damaged by the IC 910*a*. The IC 910*a* is a driving IC.

SUMMARY

According to an aspect of the invention, there is provided a printer apparatus including a platen roller, a printer head for performing a printing on a recording paper provided between the printer head and the platen roller, a recording paper guide mounted to a part of a front surface of the printer head to guide the recording paper, and a spring positioned on a rear surface of the printer head to exert force toward the platen roller. The spring causes the printer head and the recording paper guide to move together toward a position in which the platen roller is mounted.

The object and advantages of the invention will be realized and attained by means of the elements and combinations particularly pointed out in the claims.

It is to be understood that both the foregoing general description and the followed detailed description are exemplary and explanatory and are not restrictive of the invention as claimed.

DESCRIPTION OF EMBODIMENTS

In the following, embodiments of the present invention are described with reference to the accompanying drawings.

Printer Apparatus

Figure 1A:
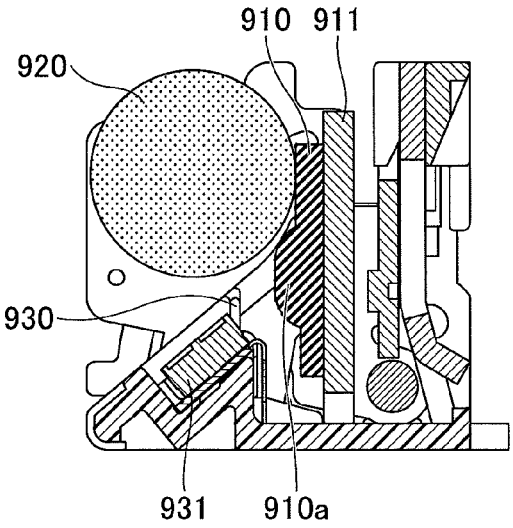
FIGS. 1A and 1B are cross-sectional views of a printer apparatus.
Figure 1B:
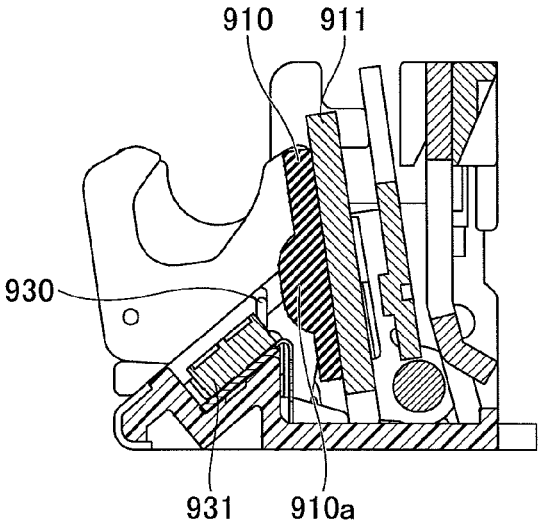
Figure 2A:
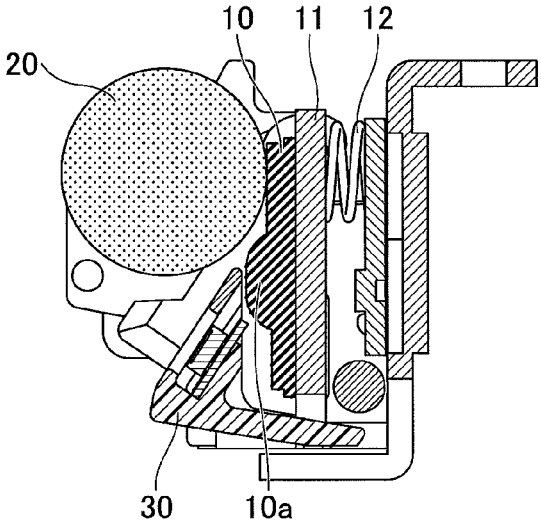
FIGS. 2A and 2B are cross-sectional views of a printer apparatus according to an embodiment of the present invention.
Figure 2B:
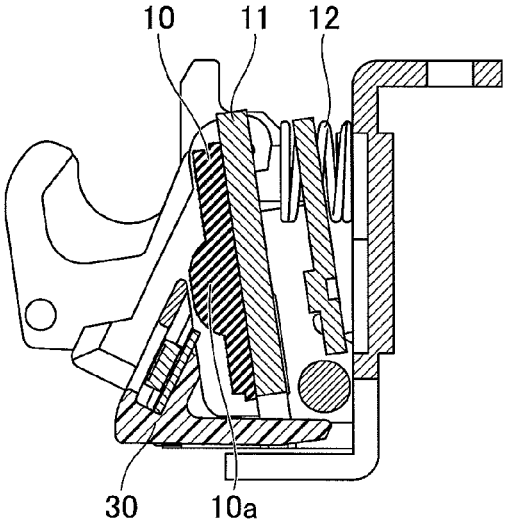

A printer apparatus according to an embodiment is described with reference to FIG. 2. FIG. 2A is a cross-sectional view illustrating a printer apparatus of the embodiment in a state having a platen roller 20 mounted thereto. FIG. 2B is a cross-sectional view illustrating the printer apparatus of the embodiment in a state where the platen roller 20 is removed therefrom.

The printer apparatus of the embodiment includes a printer body to which a thermal head 10 is mounted. The thermal head 10 includes a heat radiation plate 11 attached thereto. A spring 12 is provided on a side in which the heat radiation plate 11 is provided.

In a state where the platen roller 20 is mounted to the printer apparatus as illustrated in FIG. 2A, the thermal head 10 is pressed toward the platen roller 20 by a recovering force exerted from the spring 12. Thus, in a state where the platen roller 20 is removed from the printer apparatus as illustrated in FIG. 2B, the recovering force of the spring 12 urges the thermal head 10 to move further toward a position in which the platen roller 12 is mounted. In this embodiment, the thermal head 10 is a printer head that prints characters or the like on a recording paper (e.g., heat sensitive paper).

In this embodiment, the recording paper guide 30, which constitutes a path for conveying a recording paper, is fixed to a part of a front surface of the thermal head 10 corresponding to a printing side of the thermal head 10. Accordingly, as illustrated in FIG. 2B, in a case where the thermal head 10 is moved by the recovering force of the spring 12, the recording paper guide 30 moves together with the movement of the thermal head 10. Therefore, in this embodiment, a space between the thermal head 10 and the recording paper guide 30 can be reduced without having to consider providing a sufficient space between the thermal head 10 and the recording paper guide 30 in the case where the thermal head 10 is moved by the spring 12. Further, by reducing the space between the thermal head 10 and the recording paper guide 30, the recording paper guide 30 can be formed with a sharp inclination. Thus, the size of the recording paper guide 30 can be reduced. As a result, size-reduction of the printer apparatus can be achieved. Because the recording paper guide 30 is provided in a manner covering the IC 10*a* mounted to the thermal head 10, the IC 10*a* can be prevented from being scratched by the recording paper. The recording paper (not illustrated) is conveyed through a paper conveying path formed by the recording paper guide 30 and delivered to a space between the thermal head 10 and the platen roller 20.

Figure 3A:
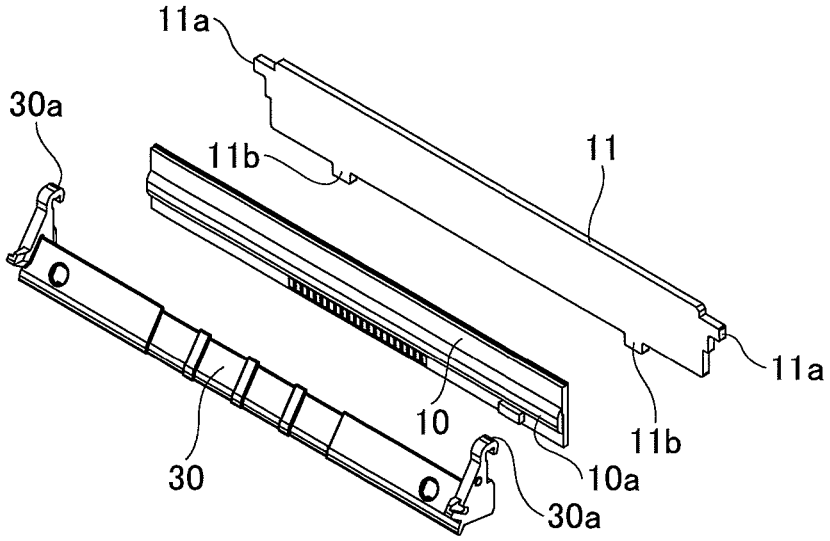
FIGS. 3A and 3B are explanatory views illustrating the printer apparatus according to the embodiment of the present invention.
Figure 3B:
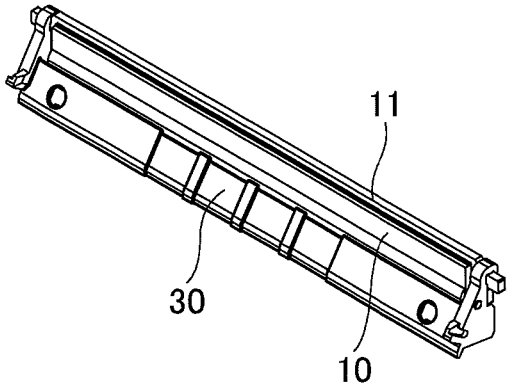

Next, a structure of the printer apparatus of the embodiment is described in further detail. As illustrated in FIGS. 3A and 3B, the printer apparatus of the embodiment includes a heat radiation plate 11 attached to a rear surface of the thermal head 10. Further, the recording paper guide 30 is attached to the front surface of the thermal head 10 corresponding to the printing side of the thermal head 10. Accordingly, the thermal head 10, the heat radiation plate 11, and the recording paper guide 30 are integrally formed. FIG. 3A is a front perspective view illustrating a disassembled state of the thermal head 10, the heat radiation plate 11 and the recording paper guide 30. FIG. 3B is a front perspective view illustrating a state where the thermal head 10, the heat radiation plate 11 and the recording paper guide 30 are formed into a single integrated body. In this embodiment, the thermal head 10, the heat radiation plate 11 and the recording paper guide 30 that form the integrated body may also be referred as a "head unit".

Figure 4A:
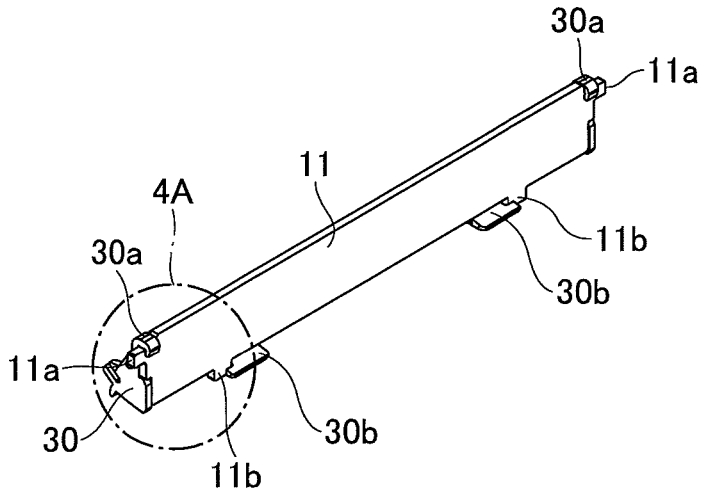
FIGS. 4A and 4B are explanatory views illustrating the printer apparatus according to the embodiment of the present invention.
Figure 4B:
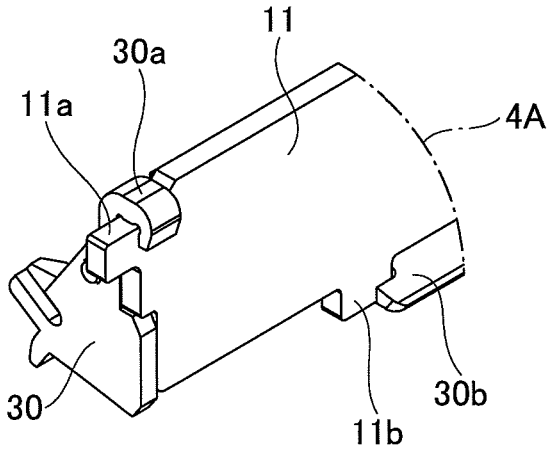
Figure 5:
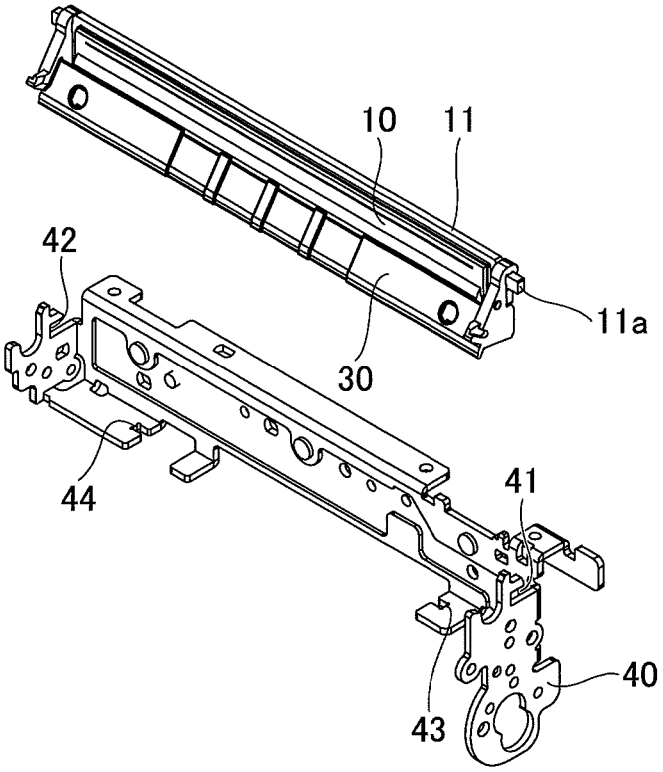
FIG. 5 is an explanatory view illustrating the printer apparatus according to the embodiment of the present invention.
Figure 6A:
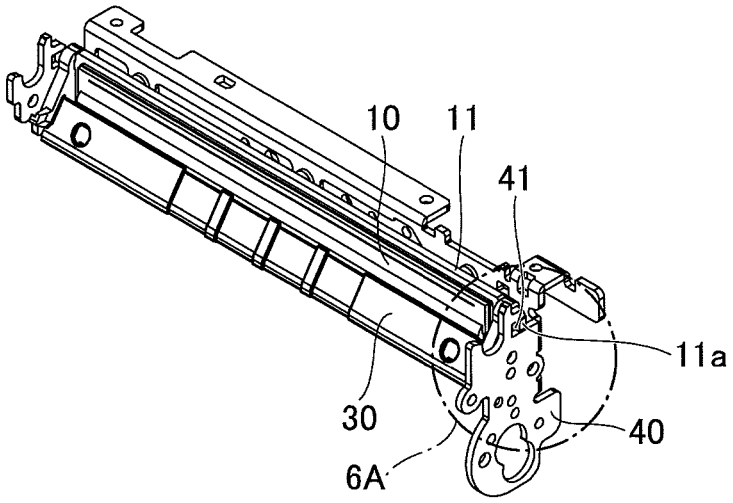
FIGS. 6A and 6B are explanatory views illustrating the printer apparatus according to the embodiment of the present invention.
Figure 6B:
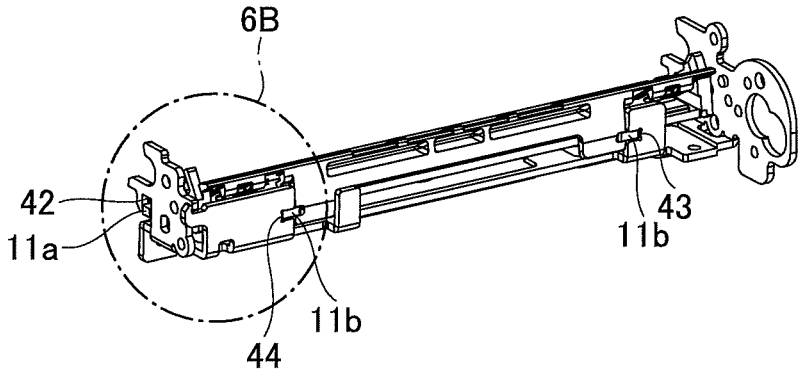

As illustrated in FIG. 3B and FIG. 5, the thermal head 10 is fixed to the heat radiation plate 11 and the recording paper guide 30 in a manner sandwiched therebetween. More specifically, the heat radiation plate 11 includes side projecting parts 11*a* provided one on each of the side surfaces on both sides of the heat radiation plate 11. The heat radiation plate 11 also includes two bottom projecting parts 11*b* provided on a bottom surface on a lower side of the heat radiation plate 11. A hook part 30*a* having a C-shape is provided in correspondence with each of the side projecting parts 11*a* in the vicinity above both ends of the recording paper guide 30, so that the recording paper guide 30 can be hooked to the side projecting part 11*a* of the heat radiation plate 11. Further, two engagement parts 30*b* having shapes corresponding to the bottom projecting parts 11*b*, respectively, are provided on a bottom surface of the recording paper guide 30, so that the engagement parts 30*b* of the recording paper guide 30 can be engaged to the bottom projecting parts 11*b* of the heat radiation plate 11. FIG. 4A is a rear perspective view illustrating a state where the thermal head 10, the heat radiation plate 11, and the recording paper guide 30 are formed into an integrated body. FIG. 4B is an enlarged view of an area surrounded by a dot-chain line in FIG. 4A.

Accordingly, in this embodiment, in a state where the thermal head 10 is sandwiched between the heat radiation plate 11 and the recording paper guide 30, each hook part 30*a* of the recording paper guide 30 is hooked to a corresponding side projecting part 11*a* of the heat radiation plate 11, and each engagement part 30*b* of the recording paper guide is engaged to a corresponding bottom projecting part 11*b* of the heat radiation plate 11. Thereby, the thermal head 10, the heat radiation plate 11, and the recording paper guide 30 can be fixed to each other and be integrally formed into a head unit.

Figure 7A:
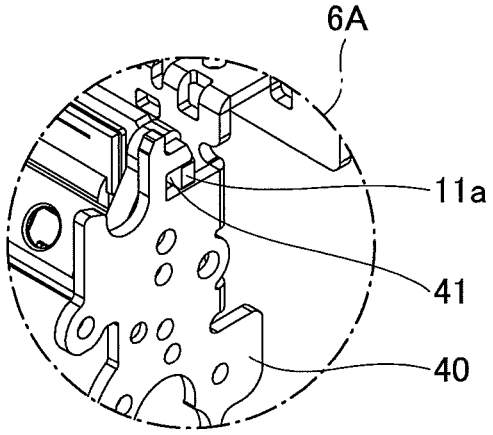
FIGS. 7A and 7B are explanatory views illustrating the printer apparatus according to the embodiment of the present invention.
Figure 7B:
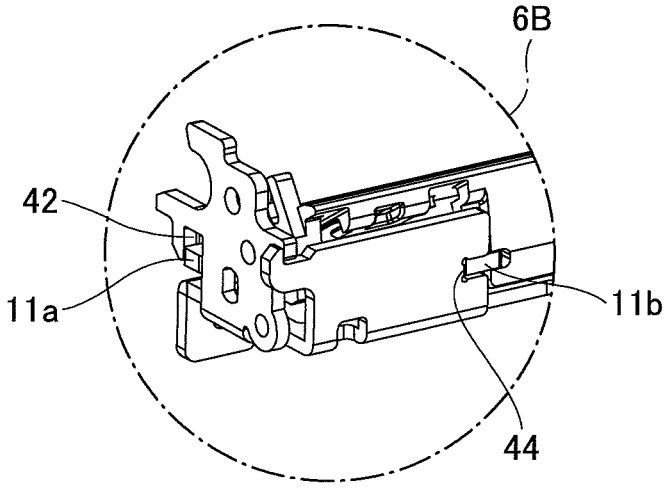

In the printer apparatus of this embodiment, the head unit, which includes the thermal head 10, the heat radiation plate 11, and the recording paper guide 30 formed as an integrated body, is attached to a frame 40 as illustrated in FIGS. 5-7B. FIG. 5 is a front perspective view illustrating a state prior to attaching the head unit to the frame 40. FIG. 6A is a front perspective view illustrating a state where the head unit is attached to the frame 40. FIG. 6B is a rear perspective view illustrating the state where the head unit is attached to the frame 40. FIG. 7A is an enlarged view of an area surrounded by a dot-chain line in FIG. 6A. FIG. 7B is an enlarged view of an area surrounded by a dot-chain line in FIG. 6B.

Side notch parts 41, 42 for defining the position of the head unit having C-shapes are provided one on each side of the frame 40. Further, bottom notch parts 43, 44 for supporting the head unit at a lower side having C-shapes are provided one on each side at a bottom part of the frame 40. The side projecting part 11*a* provided on one side of the heat radiation plate 11 of the head unit is inserted in the side notch part 41 on one side of the frame 40. The side projecting part 11*a* provided on another side of the heat radiation plate 11 is inserted in the side notch part 42 on another side of the frame 40. Further, the two bottom projecting parts 11*b* of the heat radiation plate 11 of the head unit are inserted in corresponding bottom notch parts 43, 44 of the frame 40.

Figure 8A:
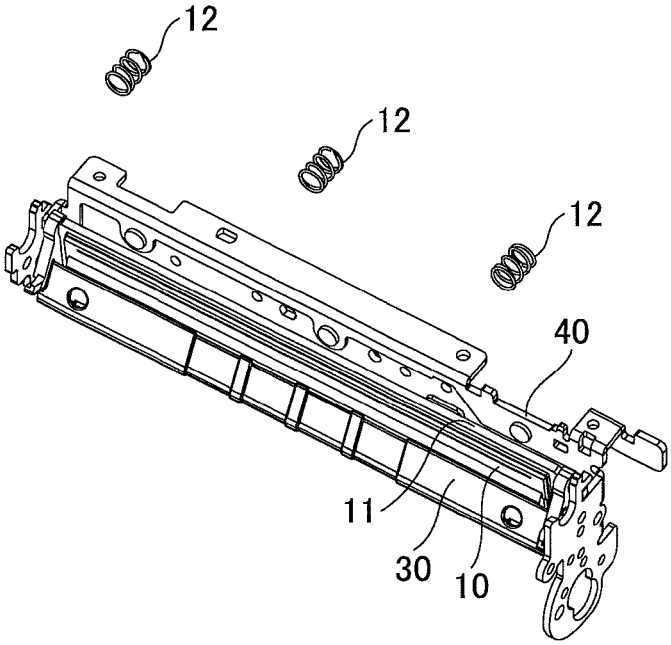
FIGS. 8A and 8B are explanatory views illustrating the printer apparatus according to the embodiment of the present invention.
Figure 8B:
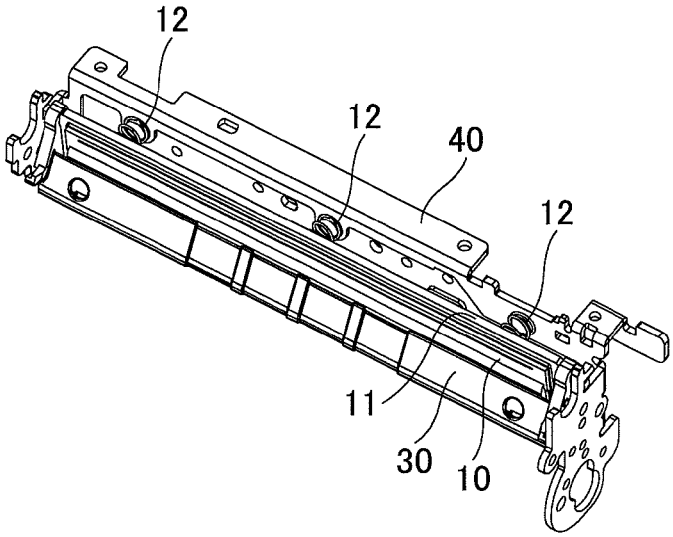

In this state, the springs 12 are mounted between the frame 40 and the heat radiation plate 11 as illustrated in FIGS. 8A and 8B. The spring 12 can exert a recovering force in its extending direction in a state being mounted between the frame 40 and the heat radiation plate 40. Although the spring 12 of this embodiment is a coil spring, other springs such as a leaf spring may be used. Accordingly, when the platen roller 20 is mounted in a position to perform a printing process, the recovering force of the spring 12 is exerted on the thermal head 10 in a direction toward the platen roller 20. Accordingly, in a case where the platen roller 20 is removed, the entire head unit moves toward a position in which the platen roller 20 is mounted. FIG. 8A is a front perspective view illustrating a state prior to mounting the springs 12 to the head unit. FIG. 8B is a front perspective view illustrating a state where the springs 12 mounted to the head unit.

Figure 9:
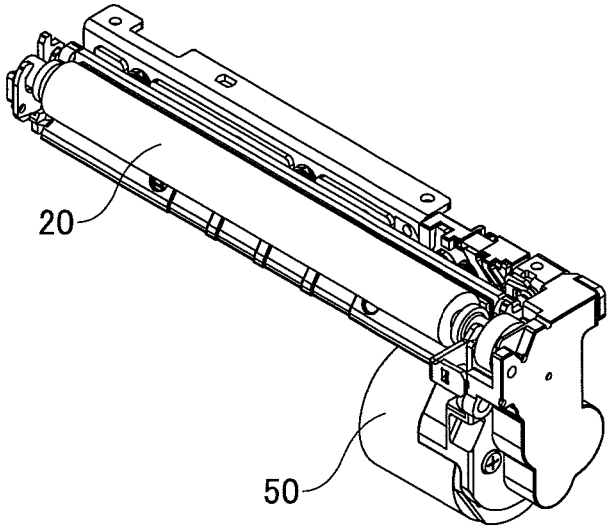
FIG. 9 is an explanatory view illustrating the printer apparatus according to the embodiment of the present invention.

According to an embodiment illustrated in FIG. 9, a motor for conveying the recording paper (conveyance motor) 50 may be attached to the frame 40 as illustrated in FIG. 8B in which the head unit is mounted, and the platen roller 20 is mounted to a predetermined part of the frame 40. Thereby, a printer apparatus without a cutter can be fabricated.

Figure 10:
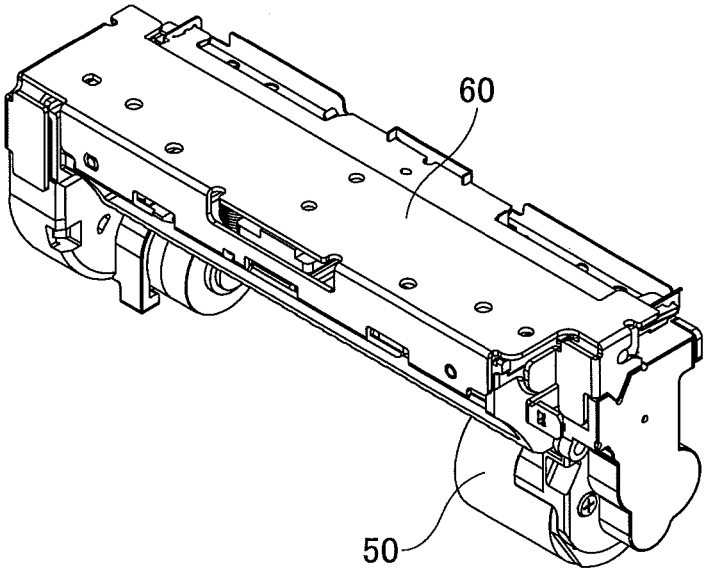
FIG. 10 is an explanatory view illustrating the printer apparatus according to the embodiment of the present invention.

Further, according to another embodiment illustrated in FIG. 10, the conveyance motor 50 and a cutter part 60 may be attached to the frame 40 as illustrated in FIG. 8B in which the head unit is mounted, and the platen roller 20 is mounted to a predetermined part of the frame 40. Thereby, a printer apparatus can be fabricated to have a structure including a cutter. The cutter part 60 may be provided with, for example, a fixed cutter, a movable cutter and a motor for moving the movable cutter.

With this embodiment, the head unit including the thermal head 10, the heat radiation plate 11, and the recording paper guide 30 can be moved together as an integrated body by the recovering force of the spring 12 in a case where the platen roller 20 is removed. Therefore, the printer apparatus including the thermal head 10, the heat radiation plate 11, and the recording paper guide 30 can be designed and manufactured without having to consider providing a sufficient space between the thermal head 10 and the recording paper guide 30. Thus, size-reduction of the printer apparatus can be achieved. Further, recording paper can be prevented from being scratched by the IC 10*a* provided in the thermal head 10 because the IC 10*a* is covered by the recording paper guide 30.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

The invention claimed is:

1. A printer apparatus comprising:

a platen roller;

a printer head for performing a printing on a recording paper provided between the printer head and the platen roller;

a heat radiation plate; and a recording paper guide that guides the recording paper;

wherein the heat radiation plate includes a first engaging member, wherein the recording paper guide includes a second engaging member, and wherein the heat radiation plate, the printer head, and the recording paper guide form an integrated body, by engaging the first engaging member with the second engaging member.

2. The printer apparatus as claimed in claim 1, wherein the heat radiation plate is mounted to a rear surface of the printer head;

wherein the first engaging member is provided on the heat radiation plate.

3. The printer apparatus as claimed in claim 2, wherein the first engaging member includes side projecting parts provided on each side of the heat radiation plate, and a bottom projecting part provided at a bottom of the heat radiation plate, wherein the second engaging member includes hook parts each of which corresponds to one of the side projecting parts, and an engagement part corresponding to the bottom projecting part, and wherein each of the hook parts is hooked to the corresponding side projecting parts, and the engagement part is engaged to the bottom projecting part in a state where the printer head is sandwiched between the heat radiation plate and the recording paper guide.

4. The printer apparatus as claimed in claim 3, further comprising:

a frame to which the printer head, the heat radiation plate, and the recording paper guide are mounted;

wherein a spring is mounted between the frame and the heat radiation plate.

5. The printer apparatus as claimed in claim 1, further comprising:

a spring positioned on a rear surface of the printer head to exert force toward the platen roller, wherein the spring causes the printer head and the recording paper guide to move together toward a position in which the platen roller is mounted.

6. The printer apparatus as claimed in claim 1, wherein the first engaging member includes a side projecting part provided on a side of the heat radiation plate, and a bottom projecting part provided at a bottom of the heat radiation plate, wherein the second engaging member includes a hook that is hooked to the side projection part, and an engagement part that is engaged to the bottom projecting part.

7. A printer apparatus comprising:

a platen roller;

a printer head for performing a printing on a recording paper;

a recording paper guide mounted to the printer head that guides the recording paper; and a heat radiation plate mounted to a rear surface of the printer head;

wherein the recording paper guide includes a first engaging member, wherein the heat radiation plate includes a second engaging member, and wherein the printer head, the recording paper guide and the heat radiation plate form an integrated body by engaging the first engaging member to the second engaging member with the printer head being sandwiched between the heat radiation plate and the recording paper guide.

8. The printer apparatus as claimed in claim 7, wherein the second engaging member includes side projecting parts provided on each side of the heat radiation plate, and a bottom projecting part provided on a bottom of the heat radiation plate, wherein the first engaging member includes hook parts each corresponding to one of the side projecting parts, respectively, and an engagement part corresponding to the bottom projecting part.

9. The printer apparatus as claimed in claim 8, further comprising:

a frame to which the printer head, the heat radiation plate, and the recording paper guide are mounted; and a spring mounted between the frame and the heat radiation plate;

wherein the spring is mounted in a position that allows a recovering force to be exerted in a direction in which the spring expands.

* * * * *